US012736051B2

(12) United States Patent
Luckner et al.

(10) Patent No.: US 12,736,051 B2
(45) Date of Patent: Sep. 15, 2026

(54) COMPRESSOR SYSTEM HAVING INTEGRATED AMBIENT SENSOR

(71) Applicant: KAESER KOMPRESSOREN SE, Coburg (DE)

(72) Inventors: Peter Luckner, Coburg (DE); Thomas Bittermann, Coburg (DE); Andreas Birkenfeld, Coburg (DE)

(73) Assignee: KAESER KOMPRESSOREN SE, Coburg (DE)

( * ) Notice: Subject to any disclaimer, the term of this patent is extended or adjusted under 35 U.S.C. 154(b) by 21 days.

(21) Appl. No.: 18/861,748

(22) PCT Filed: Dec. 13, 2023

(86) PCT No.: PCT/EP2023/085492
§ 371 (c)(1),
(2) Date: Oct. 30, 2024

(87) PCT Pub. No.: WO2024/132743
PCT Pub. Date: Jun. 27, 2024

(65) Prior Publication Data

US 2025/0290510 A1 Sep. 18, 2025

(30) Foreign Application Priority Data

Dec. 23, 2022 (DE) ..... 10 2022 134 751.6

(51) Int. Cl.
*F04C 18/16* (2006.01)
*F04C 28/28* (2006.01)
*F04C 29/04* (2006.01)

(52) U.S. Cl.
CPC ..... *F04C 18/16* (2013.01); *F04C 28/28* (2013.01); *F04C 29/04* (2013.01); *F04C 2270/19* (2013.01)

(58) Field of Classification Search
CPC ..... F04C 18/16; F04C 28/00; F04C 28/26; F04C 28/28; F04C 29/04; F04C 2240/808;
(Continued)

(56) References Cited

U.S. PATENT DOCUMENTS 5,989,312 A * 11/1999 Barnhard ..... G05D 23/1931 96/397
7,204,678 B2 * 4/2007 Truyens ..... F04C 18/16 418/84
(Continued)

FOREIGN PATENT DOCUMENTS

DE 69528112 T2 10/2002
DE 102019211409 A1 2/2021

OTHER PUBLICATIONS

International Search Report and Written Opinion corresponding to PCT/EP2023/085492. Mailed Mar. 18, 2024, (21 pages, including English translation of ISR).
(Continued)

*Primary Examiner* — Dapinder Singh
(74) *Attorney, Agent, or Firm* — Myers Bigel, P.A.

(57) ABSTRACT

The invention relates to a compressor system, in particular a screw compressor, for compressing gases, preferably air, comprising a compressor block (11) in which a compressor chamber (12) is formed in which the gas is compressed via mechanical compression means (13), wherein the compressor chamber (12) has an inlet opening (14) on the inflow side and an outlet opening (15) on the outflow side, and a control device (16) for controlling a drive (17) of the compression means (13), wherein the control device (16) is operatively connected to a temperature sensor (19) and/or a humidity sensor (20) in order to determine state conditions of the gas entering at the inlet opening (14), characterized in that the temperature sensor (19) and/or the humidity sensor (20) are
(Continued)

arranged at or in the control device (16) within the compressor system for detecting a temperature Tc prevailing there or a humidity Fc prevailing there, and the control device (16) comprises a processing device (23) in order to draw conclusions from the measured values Tc and/or Fc about the state conditions of the gas entering at the inlet opening (14).

30 Claims, 4 Drawing Sheets

(58) Field of Classification Search
CPC ..... F04C 2240/81; F04C 2270/19; F04C 2270/42; F04C 2270/195; F04C 2270/40; F04C 2270/44
See application file for complete search history.

(56) References Cited

U.S. PATENT DOCUMENTS

| | | | | |
|---|---|---|---|---|
| 8,226,378 | B2 | 7/2012 | Daniels et al. | |
| 8,459,053 | B2 | 6/2013 | Pham et al. | |
| 10,480,512 | B2 * | 11/2019 | Seghers | F04C 18/16 |
| 11,015,602 | B2 * | 5/2021 | Desiron | F04C 29/02 |
| 2004/0217180 | A1 | 11/2004 | Lu | |
| 2009/0252632 | A1 * | 10/2009 | Daniels | F04C 29/0014 418/84 |
| 2016/0076540 | A1 | 3/2016 | Pham | |

OTHER PUBLICATIONS

German Office Action corresponding to DE 102022134751.6. Dated Aug. 16, 2023, (21 pages, including English translation).

* cited by examiner

COMPRESSOR SYSTEM HAVING INTEGRATED AMBIENT SENSOR

CROSS-REFERENCE TO RELATED APPLICATIONS

This application is a 35 U.S.C. § 371 national phase application of International Application Serial No. PCT/EP2023/085492, filed Dec. 13, 2023, which claims the benefit of German Patent Application No. 10 2022 134 751.6, filed Dec. 23, 2022, the disclosures of which are incorporated by reference herein in their entireties. The above-referenced International Application was published in the German language as WO 2024/132743 A1.

FIELD

The invention relates to a compressor system, in particular a screw compressor, for compressing gases, preferably air, comprising a compressor block in which a compressor chamber is formed in which the gas is compressed by mechanical compression means, wherein the compressor chamber has an inlet opening on the inflow side and an outlet opening on the outflow side, and a method for controlling a compressor system, in particular for adjusting the temperature of the compressed gas at an outlet opening of a compressor block, taking into account state conditions of the gas flowing in at the inlet opening.

SUMMARY

With fluid-cooled compressors in particular, there is a desire to set a temperature of the compressed gas at the outlet opening of the compressor chamber to a desired target final compression temperature $T_{S,VET}$, wherein the temperature should always be high enough to prevent condensation within the compressed gas with sufficient certainty. At the same time, however, the target final compression temperature $T_{S,VET}$ Should not be set too high, which can be achieved, for example, via a fluid cooling circuit that cools the compressor chamber. Particularly in compressors that are cooled via a fluid cooling circuit, the target final compression temperature $T_{S,VET}$ should not be set too high in order to protect the cooling fluid.

A generic compressor system is already known from U.S. Pat. No. 8,226,378 B2. There, in a screw compressor, the formation of condensate in the compressed gas is prevented by controlling the cooling capacity of an oil cooling circuit via a bypass valve. In the proposed adjustment of the temperature of the compressed gas at the outlet opening of the compressor chamber, a temperature sensor and a humidity sensor are also used to determine the state conditions for the supply air flowing into the compressor chamber. Specifically, in a preferred design, it is proposed that the temperature sensor for detecting a gas temperature $T_{ein}$ representative of the condition of the gas at the inlet opening on the inflow side and the humidity sensor for detecting a humidity $F_{ein}$ representative of the condition of the gas at the inlet opening on the inflow side be arranged on the outside of the compressor system.

Although this makes it possible in principle to determine the state conditions for the gas flowing into the compressor chamber, the teaching proposed there nevertheless has some disadvantages.

As far as the temperature sensor is concerned, falsified values can result, for example, from the fact that the sensor is exposed to waste heat from the machine. This effect is amplified if the intake volume flow is low and a relatively high proportion of gas heated by the waste heat is drawn in.

As far as the humidity sensor is concerned, it is exposed to correspondingly high particle loads or contamination outside the compressor unit, with the result that measurement results are falsified. The effect of soiling is noticeable outside the compressor unit and increases significantly as the operating time progresses.

It is also conceivable to place a temperature sensor or a humidity sensor downstream of the intake air filter and upstream of an inlet valve in a compressor system. A filtered gas flow is usually present in this area; however, oil mist can form when the compressor system is vented. This exposes the temperature and humidity sensor to a certain risk of soiling. Furthermore, the entire intake volume flow of the compressor system flows through the area between the air filter and inlet valve, so that due to the relatively high volume flow, there is a relatively high particle load for the temperature and humidity sensor over the entire service life despite the presence of the inlet filter.

It is the object of the present invention, on the other hand, to propose a solution based on the prior art discussed, in which the determination of a desired temperature $T_{VET}$ of the compressed gas at the outlet opening of the compressor chamber can be determined even more reliably, taking into account the state conditions of the gas flowing in at the inlet opening. In this respect, a structurally improved solution is also to be created.

This object is solved in terms of device technology with a compressor system according to the features the claims and in terms of process technology by the features of the claims.

A core idea of the present invention is to arrange the temperature sensor and/or the humidity sensor at or in the control device within the compressor system for detecting a temperature $T_c$ or a humidity $F_c$ prevailing there, wherein the control device comprises a processing device for drawing conclusions from the measured values $T_c$ and/or $F_c$ about the state conditions of the gas entering at the inlet opening.

State conditions of the gas entering at the inlet opening can be understood as individual physical parameters or a combination of physical parameters, such as in particular a temperature $T_{ein}$, a humidity $F_{ein}$, a dew point $Tau_{ein}$, a water vapor content $WDG_{ein}$ or a pressure $P_{ein}$. With regard to the steps mentioned in connection with the subject of the invention, such as "determining", "closing back", "controlling the actuator", it is clarified that these steps are carried out automatically by the control device independently.

The proposed solution has several advantages. On the one hand, the humidity sensor and temperature sensor are much better protected against soiling or damage with this design than if they are fitted at or in the intake area of the compressor unit. In addition, production is simplified as no long supply lines are required for power supply and/or data transmission. Finally, operation is also improved, as a more direct connection to the control device also brings further practical advantages in terms of operation: The processing of the process data value in the form of calibration, characteristic curve correction, measuring range adjustment, etc. can take place directly within the control device or directly within the MEMS sensor when connected to the control device, especially if the humidity sensor and/or the temperature sensor is integrated into a MEMS sensor, and a digital value is provided at the data interface.

Conventional sensors, on the other hand, usually have analog interfaces (0 . . . 10 V or (0) 4 . . . 20 MA), which must be read in via an analog input circuit and scaled, standardized and, optionally, zero-point corrected and calibrated accordingly. A subsequent analog-to-digital converter is required to process the process value. These processing procedures are subject to errors and are also subject to a certain amount of drift due to the changes in the components used over time.

Discrete sensors, which already have appropriate internal signal processing and make the data available digitally, e.g. via a fieldbus interface, are preferable here. However, such sensors are expensive.

A humidity and/or temperature sensor integrated into the control unit can already be put into operation with the control unit. In this respect, these sensors can therefore be decoupled from the compressor in terms of time and space, commissioned and function-tested, in contrast to the aforementioned discrete sensors, which only provide data after installation and commissioning.

A possible prejudice that the conditions of the gas entering at the inlet opening must be determined as close as possible to the inlet opening in the compressor room has proven to be unfounded. On the one hand, correction factors or a corresponding allocation table can be used to draw conclusions about the conditions in the area of the inlet opening, and on the other hand, the values relating to the absolute humidity, i.e. the dew point or water vapor content, do not differ noticeably between the environment at the inlet opening on the inflow side of the compressor room on the one hand and the conditions at or in the control device. In this respect, it has been shown that the values representative of the state conditions of the gas in the area of the inlet opening on the inflow side can also be determined using a temperature sensor or a humidity sensor, which is arranged at or in the control device within the compressor system. It is understood that this assumes a certain gas exchange between the gas in the vicinity of the inlet opening on the inflow side on the one hand and the gas at or in the control device.

In a preferred further development of the present invention, the compressor system also comprises an actuating means, in particular a cooling fluid bypass valve, and the control device controls the actuating means based on the state conditions of the incoming gas at the inlet opening determined from $T_c$ and/or $F_c$.

Although the control of one or more actuating means is dependent on the determined state conditions, the state conditions determined according to the invention can also be used for various other applications or be used there.

In a possible design, the control device is also designed and set up, based on the state conditions of the incoming gas at the inlet opening determined from $T_c$ and/or $F_c$, to control the compressor system in such a way that the temperature of the compressed gas at the outlet opening of the compressor chamber follows a target final compression temperature $T_{S,VET}$.

In a further design, the control device is further operatively connected to a pressure sensor in order to also detect a pressure value $P_c$ and, taking into account the pressure value $P_c$, to draw even more precise conclusions about the state conditions of the gas entering at the inlet opening.

In a further design, the pressure sensor is arranged at or in the control device within the compressor system.

In a preferred design, the control device is accommodated in a control housing within the compressor unit, wherein the temperature sensor and/or the humidity sensor are also accommodated within the control housing.

In a preferred design, the control housing is at least largely closed, in particular closed except for a few openings, in particular except for two openings. The control housing can be a housing that directly encloses the electronic control device. In this case, the volume enclosed by the control housing essentially corresponds to the volume occupied by the electronic control device or is not significantly larger. However, the control housing can also be realized by a control cabinet in which other electronic components, such as a power supply, are accommodated in addition to the control device itself. The temperature sensor and/or the humidity sensor are even better protected from harmful external influences, such as damage or soiling, by being housed inside the control housing.

A particularly preferred design is that the temperature sensor and/or the humidity sensor can be integrated on a circuit board on which electronic components of the control device, in particular a main processor of the control device, are also arranged. The main processor can form the processing device of the control device.

Integration on a circuit board of the control device creates a particularly favorable solution in terms of production technology and operation. Temperature sensors and humidity sensors are available today as miniaturized components that can be easily integrated onto a circuit board. In this respect, the functionality of a temperature sensor for detecting state conditions of the gas entering at the inlet opening, for example a dew point $Tau_{ein}$ of the gas in the vicinity of the inlet opening on the inflow side or for estimating a temperature $T_{ein}$ representative of the environment at the inlet opening of the compressor room on the inflow side or a humidity $F_{ein}$ representative of the environment at the inlet opening on the inflow side of the compressor chamber can easily be realized by electronic components that can be integrated on the circuit board with other components of the control device, such as the main processor, in a preferably automated process. This reduces manufacturing costs, in particular connection and cabling costs, when implementing the compressor system. At the same time, a close connection to the main processor of the control device is made possible, so that signal runtimes and transmission errors can be significantly reduced.

In a very specific preferred design, the temperature and/or humidity sensor can be designed as a MEMS sensor. Although the humidity sensor and temperature sensor could also be realized separately, it is nevertheless conceivable to form the humidity sensor and temperature sensor in a common MEMS sensor. MEMS sensors (micro-electromechanical systems) are commonly used today in many areas of technology, especially in air conditioning technology, and are offered by various manufacturers. The functionality of detecting the state conditions of the gas entering at the inlet opening, for example a dew point $Tau_{ein}$ or a water vapor content $WDG_{ein}$ of the gas in the vicinity of the inlet opening or a temperature representative of the environment at the inlet opening of the compressor room or for detecting a humidity representative of the environment at the inlet opening of the compressor room can thus be implemented cost-effectively.

At the same time, a closer connection in spatial and functional terms to the control device, in particular a main processor of the control device, can be created. In a preferred further development, fluidic coupling means are provided at or in the control device in order to couple or better couple the temperature sensor and/or the humidity sensor to the environment or to the air in the environment upstream of the inlet opening.

In this respect, such fluidic coupling means can comprise corresponding openings in the control housing of the control device. Through such openings, ambient air, in particular ambient air from the vicinity of the inlet opening of the compressor chamber, can be introduced into the control housing and directed to the temperature sensor and/or humidity sensor and subsequently also discharged from the control housing.

The fluidic coupling means can also include a cooling air flow guide and/or a fan to guide or drive the supply air flow. In one possible design, the cabinet ventilation already provided in a control cabinet is included, i.e. the desired supply air flow for supplying air from the environment at the inlet opening of the compressor room or air with the same or similar state conditions can be realized by the cabinet ventilation already provided.

In a further preferred design, the fluidic coupling means can also comprise a cooling air flow guide formed in the control housing for guiding a cooling air flow, wherein the fan is provided to drive the cooling air flow. The cooling air flow guide within the control housing can be used to determine which components of the control device the cooling air flow is to be directed to and in which sequence, wherein in a first possible design the cooling air flow or the supply air flow for the temperature sensor and/or the humidity sensor should not yet be subjected to waste heat from the components to be cooled, i.e. the supply air flow is first directed to the temperature sensor and/or the humidity sensor and only then absorbs waste heat from the control device and is discharged from the control housing as a cooling air flow.

In an alternative possible design, the cooling air flow or the supply air flow is first routed via the components to be cooled and only then via the temperature sensor and/or the humidity sensor. In this case, the cooling air flow or the supply air flow first absorbs the waste heat from the control device before it reaches the temperature sensor or humidity sensor. However, this is equally suitable for determining the absolute humidity or for determining a dew point, as the absolute humidity is not affected by this heating. At the same time, there is the advantage that the lower relative humidity counteracts condensation on the humidity sensor and therefore improves the reliability of the humidity measurement. In general, it should be noted that integrated humidity sensors are also available that have an internal heater to prevent condensation, which is switched on if there is a risk of condensation.

In a further preferred design, a filter is provided and arranged in the cooling air flow guide in such a way that the supply air flow is first guided over the supply air filter before it reaches the temperature sensor and/or the humidity sensor. This allows further particles to be removed from the supply air so that contamination of the temperature sensor and/or the humidity sensor is further counteracted.

In a preferred design, the spacing between the temperature sensor and the main processor of the control device is less than 30 cm, preferably less than 20 cm. Alternatively or additionally, in a preferred design, the spacing between the humidity sensor and the main processor of the control device is less than 30 cm, preferably less than 20 cm.

In a preferred design of the present invention, the temperature sensor is connected directly to the main processor of the control device and the humidity sensor is connected directly to the main processor of the control device, in particular without the intermediate connection of further components, interfaces, etc. This procedure allows a direct connection and avoids longer signal propagation times, faulty transmissions or requirements for the structural or programming design of interfaces.

In a preferred design, the compressor system has a fluid cooling circuit whose cooling capacity can be adjusted via actuating means, such as one or more valves, wherein the control device adjusts the cooling capacity of the fluid cooling circuit taking into account the state conditions of the gas flowing in at the inlet opening determined via the temperature sensor or via the humidity sensor, in particular taking into account the temperature $T_{ein}$ or humidity $F_{ein}$ of the gas flowing in at the inlet opening determined in this way. In this respect, the cooling capacity can be increased or reduced depending on the determined values $T_{ein}$ or $F_{ein}$ or the dew point $Tau_{ein}$ or water vapor content $WDG_{ein}$ determined from this.

Taking into account the absolute humidity or the dew point in the vicinity of the inlet opening in particular, this ensures that condensation in the compressed gas is avoided with sufficient certainty and that the temperature $T_{VET}$ can be kept as low as possible at the same time.

Specifically, the temperature $T_{ein}$ and the humidity $F_{ein}$ can be used to determine the water vapor content/the dew point of the drawn-in gas and thus determine a minimum required target final compression temperature $T_{S,VET}$ as an input variable/setpoint for a VET controller to avoid condensation. This controller controls the actuator(s) in the fluid circuit and/or the quantity of cooling medium and/or a speed of a fan motor to a cooling fluid cooler. The factually actual final compression temperature $T_{I,VET}$ is measured at the outlet of the compressor block.

In a specifically preferred design, the actuating means comprise a cooling fluid bypass valve which is operatively connected to the control device and by means of which it is possible to gradually adjust the amount of cooling fluid which is fed via a heat exchanger integrated in the fluid cooling circuit or which is fed past the heat exchanger integrated in the fluid cooling circuit. This design for regulating the cooling capacity of the cooling fluid circuit is common practice in compressor systems. Reference is again made to the aforementioned U.S. Pat. No. 8,226,378 B2 purely by way of example.

The method according to the invention for controlling a compressor system, in particular for adjusting the actual final compression temperature $T_{I,VET}$ of the compressed gas at an outlet opening of a compressor block, taking into account state conditions of the gas flowing in at the inlet opening, wherein a temperature sensor or a humidity sensor is used to determine a temperature $T_c$ and/or a humidity $F_c$ at or in a control device in order to detect a temperature $T_c$ prevailing at or in the control device or a humidity $F_c$ prevailing at or in the control device, and that the measured values $T_c$ and/or $F_c$ are used to draw conclusions about the state conditions of the gas entering at the inlet opening.

In an advantageous design of the present method, the temperature $T_c$ measured at the temperature sensor at or in the control device and the humidity $F_c$ measured at the humidity sensor at or in the control device are used to calculate a dew point $Tau_c$ representative of the air in the region of the control device or another value $WDG_c$ representative of the water vapor content of the air in the area of the control device and the dew point $Tau_c$ or the value $WDG_c$ representative of the water vapor content is taken into account when determining the target final compression temperature $T_{S,VET}$ of the compressed gas at the outlet opening of the compressor block.

In another preferred further development of the method, the temperature $T_c$ or the humidity $F_c$ is determined in a supply air flow conducted via the control device.

In a preferred further development of the method, the supply air flow passes through a filter to remove particles from the supply air before it reaches the temperature sensor or the humidity sensor.

In a possible preferred design, the temperature $T_c$ measured at the temperature sensor is used to infer a temperature of the gas $T_{ein}$ at the inlet opening of the compressor chamber.

In another possible preferred design, the temperature $T_c$ measured at the temperature sensor and the humidity $F_c$ measured at the humidity sensor are used to infer a dew point $Tau_{ein}$ or a water vapor content $WDG_{ein}$ of the gas at the inlet opening of the compressor chamber. In this respect, inference also includes derivation, determination or calculation by the control device.

In a further possible preferred design, the compressor system is cooled via an adjustable fluid cooling circuit in order to keep a factually actual final compression temperature $T_{I,VET}$ as close as possible to a target final compression temperature $T_{S,VET}$, wherein the cooling capacity of the fluid cooling circuit is set taking into account the state conditions of the gas flowing in at the inlet opening of the compressor system, in particular taking into account the temperature $T_{ein}$ or the humidity $F_{ein}$ determined in this way.

In another possible preferred design, the cooling capacity of the cooling fluid circuit is set via a bypass regulation.

In a further preferred design of the method according to the invention, it may be provided that a pressure at or in the vicinity of the control device is determined via a pressure sensor, wherein the pressure determination is preferably carried out by a pressure sensor at or in the control device.

For clarification, please note that the humidity $F_c$ measured by the humidity sensor is a relative humidity and not an absolute moisture/humidity.

The invention is also explained in more detail below with regard to further features and advantages by means of the description of exemplary embodiments and with reference to the accompanying drawings, wherein:

DETAILED DESCRIPTION

Figure 1:
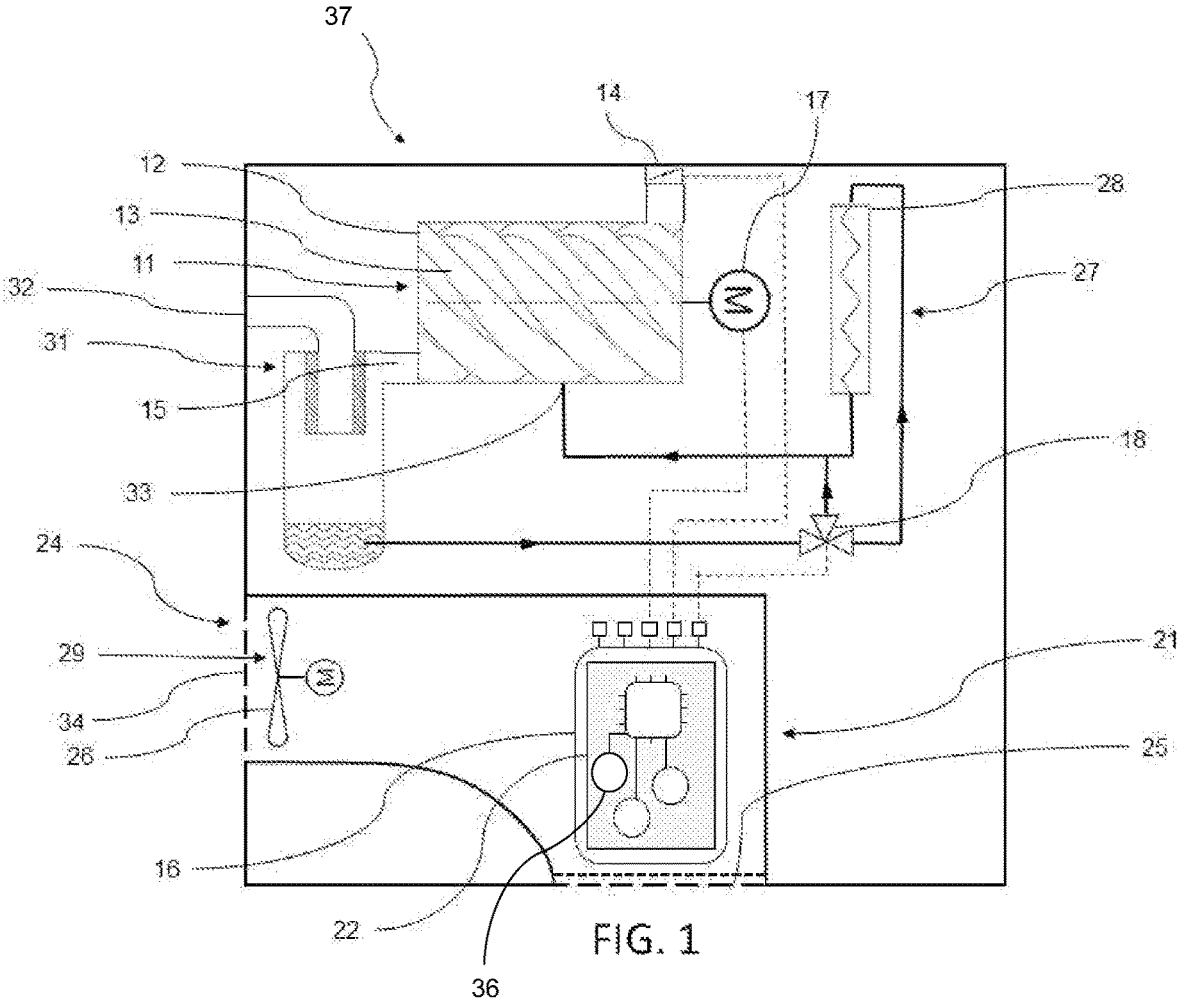
FIG. 1 shows a schematic representation of a compressor system provided with a fluid cooling circuit, which is equipped with a temperature sensor according to the invention and a humidity sensor according to the invention for determining the gas temperature $T_{ein}$ and the gas humidity $F_{ein}$.

FIG. 1 shows a schematic representation of a compressor system 37 provided with a fluid cooling circuit 27, which is equipped with a temperature sensor 19 according to the invention and a humidity sensor 20 according to the invention for determining in each case a gas temperature $T_{ein}$ and a gas humidity $F_{ein}$ at an inlet opening 14 of a compressor block 11. The compressor block 11 comprises the aforementioned inlet opening 14, a compressor chamber 12 enclosed by the compressor block 11 and an outlet opening 15. Mechanical compression means 13, here specifically two screws, are mounted in the compressor chamber 12, which compress gas flowing into the inlet opening 14 according to the principle of a screw compressor and discharge it at an outlet opening.

The outlet opening 15 is connected to an oil separator 31, into which the compressed gas enters and a cooling and lubricating fluid, in this case oil, is separated. The compressed gas freed from the cooling fluid, in this case oil, is fed to a consumer or consumer network via an outlet line 32. The oil separator 31 is also a component of the aforementioned fluid cooling circuit 27, which returns the cooling fluid separated from the compressed gas, in this case oil, to the compressor chamber 12 via an injection point 33.

In order to be able to adjust the temperature of the cooling fluid returned to the injection point 33, an actuating means, which is specifically designed here as a cooling fluid bypass valve 18, is provided in order to optionally return the cooling fluid directly from the oil separator to the injection point or to guide it in whole or in part via a heat exchanger 28 before it is returned to the injection point 33.

The compressor system further comprises a control device 16, which is accommodated in a control housing 21 on or within the compressor system. The control housing 21 has a first opening 25 on the inflow side and a second opening 34 on the outflow side in order to be able to guide an air flow through the control housing 21. In order to drive the aforementioned air flow, a fan 26 is provided, preferably on the outflow side of the control device 16.

The control device 16 comprises one or more circuit boards 22 on which, for example, a main processor 23 of the control device 16 is arranged. Furthermore, in a preferred design of the present invention, the aforementioned temperature sensor 19 or the aforementioned humidity sensor 20 can also be arranged on a circuit board 22 of the control device 16, preferably on the circuit board 22 on which a main processor 23 of the control device is also arranged, and in this respect this circuit board can also be referred to as the main circuit board.

In a further preferred design, the temperature sensor 19 and/or the humidity sensor 20 are connected directly to the main processor 23 of the control device 16, i.e. no further interfaces or other components are connected in between. The circuit board 22 with the main processor 23 of the control device 16 is preferably arranged within the control housing 21 in such a way that an air flow entering from the inflow-side opening 25 first passes over the temperature sensor 19 and the humidity sensor 20 before it is heated by the main processor 23 and/or the fan 26. In a particularly preferred design, temperature sensor 19 and/or humidity sensor 20 are designed as MEMS sensors (micro-electro-mechanical systems).

In the specific embodiment described here, the control device 16 is still operatively connected to a pressure sensor 36, which is designed to detect a pressure value $P_c$. Preferably, the pressure sensor 36 is also arranged on a circuit board 22 of the control device 16, preferably also on the circuit board 22 on which a main processor 23 control device is also arranged. Particularly preferably, the pressure sensor 36 is also designed as a MEMS sensor. The gas or air pressure can be determined via the pressure sensor 36. The air pressure has an influence on the compression process and may also influence other parameters of the compressor system. The air pressure de-pends largely on the installation altitude of the compressor unit above sea level, but is also influenced by weather conditions, for example. However, the latter only have a comparatively minor effect.

Without existing sensors for the air pressure, an atmospheric air pressure of 1.0 bar is usually used for calculations, which would correspond to an installation of the compressor unit at sea level. This simplifies the calculation to the effect that only the final compression pressure is taken into account for the pressure ratio Π and therefore not the intake air pressure. This simplification means that a suitable safety margin must be taken into account when calculating the target final compression temperature $T_{S,VET}$.

If the air pressure $p_1$ is known, it can be taken into account in the calculation and the pressure ratio $\Pi=p_1/p_2$ applies with $p_1$ intake air pressure in bar (abs), $p_2$ final compression pressure in bar (abs). With $p_1$=1.0 bar (abs), $\Pi=p_2$ applies. If $p_1$ is less than 1.0 bar (abs), e.g. due to a higher installation altitude of the compressor unit above sea level, the pressure ratio Π increases and therefore has a corresponding influence on the target final compression temperature $T_{S,VET}$ to be calculated.

Figure 2:
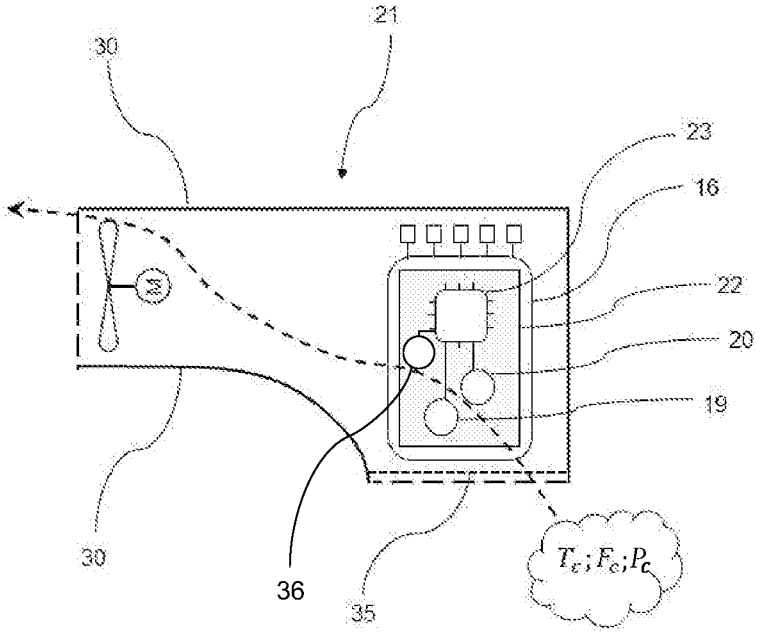
FIG. 2 shows a control device of a compressor system equipped with a corresponding temperature sensor or humidity sensor.

In FIG. 2, the control housing 21 from FIG. 1 is illustrated again in isolation with the control device 16 housed in it. Reference is made to the description in connection with FIG. 1. A cooling air flow guide 30, which guides the cooling air flow driven by the fan 26 in a desired path, can be defined by structural designs of the control housing 21 or corresponding devices. In order to further reduce contamination of the temperature sensor 19 or the humidity sensor 20, an air filter 35 is advantageously arranged in the cooling air flow guide 30, preferably in the area of the inflow-side opening 25, in order to retain particles from the inflowing air.

With the arrangement proposed here, the temperature sensor 19 and the humidity sensor 20 can determine a gas temperature representative of the gas temperature or the gas humidity at the inlet opening 14 of the compressor chamber 12. Optionally, the specifically measured temperature or the specifically measured humidity can still be corrected using correction factors or correlation tables in order to infer the value $T_{ein}$ Or $F_{ein}$, i.e. the gas temperature or the gas humidity at the inlet opening 14 of the compressor chamber 12, even more accurately. In addition to calculating or estimating a temperature $T_{ein}$ or a humidity $F_{ein}$, the measured values of the temperature $T_c$ at or in the control device 16 and the humidity $F_c$ at or in the control device 16 can be used to infer a dew point $Tau_c$ or the water vapor content $WDG_c$ of the gas in the area of the control device 16. The calculated value $Tau_c$ or $WDG_c$ can be used to directly infer the dew point $Tau_{ein}$ or the water vapor content $WDG_{ein}$ at the inlet opening 14 of the compressor chamber 12, wherein the value $Tau_c$ or $WDG_c$ can be assumed to be 1:1 or correction factors can be included. In general, however, it can be assumed that the absolute water vapor content of the gas at both locations, namely at or in the control device 16 on the one hand and in the area of the inlet opening 14 of the compressor chamber 12 on the other hand, is the same or at least essentially the same.

Figure 3:
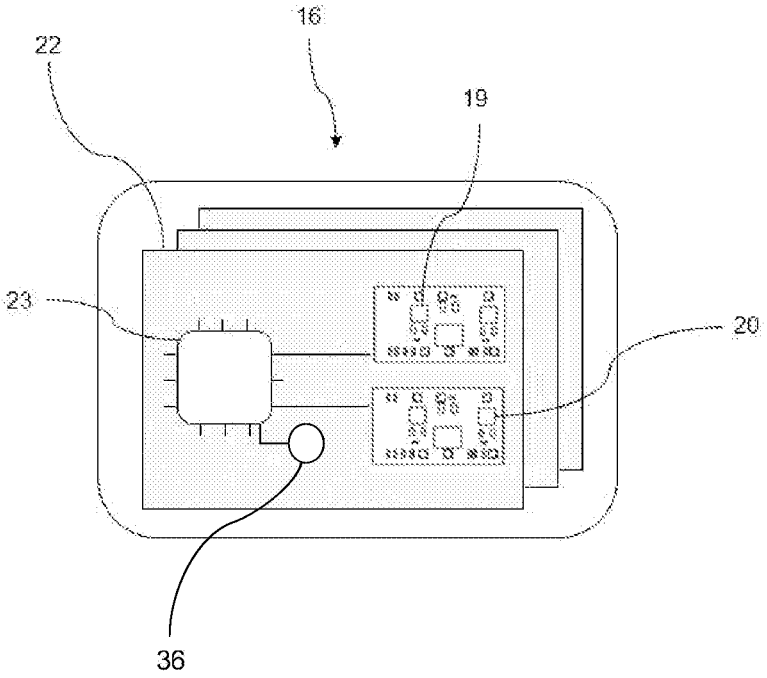
FIG. 3 shows a first alternative design for integrating a humidity sensor and a temperature sensor and a humidity sensor on a circuit board of a control device of a compressor system.

FIG. 3 illustrates a design in which the temperature sensor 19 and the humidity sensor 20 are designed as MEMS sensors and are each connected directly to the main processor 23 of the control device 16.

Figure 4:
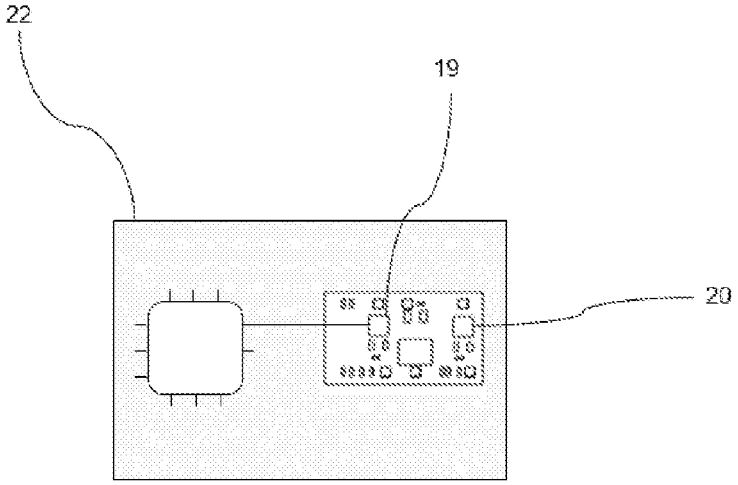
FIG. 4 shows an alternative embodiment for realizing the integration of a temperature sensor and a humidity sensor on a circuit board of a control device of a compressor system.

FIG. 4 illustrates a design in which the temperature sensor 19 and the humidity sensor 20 are integrated in a common MEMS sensor and this is connected directly to the main processor 23 of the control device 16.

In a preferred aspect of the present invention, the dew point Tau is determined from the measurement of the temperature $T_c$ and the associated relative humidity $F_c$ at or in the control device 16. These pairs of values allow the water vapor content $WDG_c$ and the dew point $Tau_c$ to be calculated. It is assumed that, without additional effects, the water vapor content of the interconnected gas volumes, namely the gas volumes in the area of the control device 16 on the one hand and the inlet opening 14 at the compressor chamber 12 on the other hand, is the same or essentially the same. Consequently, in the case of a compressor which draws in gas, in particular air, from its surroundings, the dew point can be determined in each gas volume which is also directly connected to the surroundings of the inlet opening of the compressor. The dew point is determined exclusively by the water vapor content of the gas drawn in by the compressor. The water vapor content is independent of fluctuations in the gas temperature within certain limits, but can only be determined indirectly by measuring the gas temperature and relative humidity. According to an advantageous aspect of the present invention, the gas temperature $T_c$ and the relative humidity $F_c$ are recorded at or in the control device for this purpose. If a heat source were to lead to an increase in temperature, the relative humidity is reduced in the same way, since the water vapor content does not change as a result of the temperature change. This means that the temperature sensor 19 and the humidity sensor 20 can also be placed in a warmer area of the machine, namely at or in the control device.

An additional advantage results from the fact that the placement of the humidity sensor 20 at or in the control device 16 counteracts condensation on this humidity sensor 20. If the temperature sensor 19 or the humidity sensor 20 is positioned in the control cabinet, a relatively low particle load can be assumed, as cooling air for the control cabinet is always filtered. There is a risk of condensation forming on the temperature sensor 19 or humidity sensor 20 if the relative humidity approaches 100%. This would be the case if the temperature and dew point approach each other. If the dew point remains the same, an increase in temperature leads to a reduction in relative humidity and consequently to a reduced risk of sensor dew. In the prior art, in which humidity sensors are arranged on the outside or at or in the outlet area of the compressor, there is the additional risk that a dew coating forms on the humidity sensor at colder gas temperatures and that the measurement of the relative humidity is falsified or is not possible due to this dew formation. In this respect, the solution proposed here can also overcome this problem.

By determining the pressure $P_c$ of the ambient air, this influence on the target final compression temperature $T_{S,VET}$ can be taken into account. This makes the detection of the state conditions of the gas entering at the inlet opening of the compressor unit more accurate, on the one hand in that weather fluctuations are also taken into account, but above all in that if an incorrect installation altitude above sea level is entered when the compressor unit is initialized, such incorrect parameterization can be corrected by the actual detection of the pressure $P_c$ of the ambient air.

LIST OF REFERENCE SIGNS

11 Compressor block
12 Compressor chamber
13 Compression means
14 Inlet opening
15 Outlet opening
16 Control device
17 Drive

18 Actuating means, cooling fluid bypass valve
19 Temperature sensor
20 Humidity sensor
21 Control housing
22 Circuit board
23 Main processor
24 Flow coupling means
25 Inlet side opening
26 Fan
27 Fluid cooling circuit
28 Heat exchanger
29 Housing ventilation
30 Cooling air flow guide
31 Oil separator
32 Outlet line
33 Injection point
34 Opening on the outflow side
35 Air filter
36 Pressure sensor
37 Compressor system

The invention claimed is:

1. A compressor system for compressing gas, comprising:

a compressor block in which a compressor chamber is formed in which the gas is compressed via mechanical compression means, wherein the compressor chamber has an inlet opening on an inflow side and an outlet opening on an outflow side;

a control housing, the control housing being closed except for a first opening on the inflow side and a second opening on the outflow side, the first opening separate from the inlet opening;

a control device comprising a processing device disposed in the control housing for controlling a drive of the compression means;

at least one of a temperature sensor and a humidity sensor disposed in the control housing between the first opening and the second opening and operatively connected to the control device to detect at least one of a temperature $T_c$ and a humidity $F_c$ of a supply gas flow in the control housing entering at the first opening, the control device using the measured values $T_c$ and $F_c$ in the processing device to draw conclusions about state conditions of an incoming gas entering at the inlet opening.

2. A compressor system according to claim 1,
wherein the compressor system comprises a cooling fluid bypass valve, and the control device controls the cooling fluid bypass valve via corresponding control commands based on the state conditions of the incoming gas at the inlet opening determined from $T_c$ and/or $F_c$.

3. A compressor according to claim 1,
wherein the control device is furthermore designed and set up, based on the state conditions of the incoming gas at the inlet opening determined from $T_c$ and/or $F_c$, to control the compressor system in such a way that the temperature of the compressed gas at the outlet opening of the compressor chamber follows a target final compression temperature $T_{S,VET}$.

4. A compressor system according to claim 1,
wherein the control device is further operatively connected to a pressure sensor in order to also detect a pressure value $P_c$ and, taking into account the pressure value $P_c$, to draw conclusions about the state conditions of the incoming gas.

5. A compressor system according to claim 4,
wherein the pressure sensor is disposed in the control housing also arranged at or in the control device within the compressor system.

6. A compressor system according to claim 1,
wherein the control device comprises one or more circuit boards with electronic components comprising the processing device of the control device, and at least one of the temperature sensor and the humidity sensor.

7. A compressor system according to claim 1,
wherein the temperature sensor is designed as a MEMS sensor.

8. A compressor system according to claim 1,
wherein the humidity sensor is designed as a MEMS sensor.

9. A compressor system according to claim 1,
wherein the temperature sensor and the humidity sensor are integrated in a MEMS sensor.

10. A compressor system according to claim 1,
wherein the temperature sensor and the humidity sensor are coupled to an environment around the compressor system upstream of the inlet opening.

11. A compressor system according to claim 10,
wherein the first opening is located upstream of the inlet opening.

12. A compressor system according to claim 10,
wherein the control housing comprises at least one of a cooling air flow guide and a fan to guide or drive the supply gas flow.

13. A compressor system according to claim 12,
wherein the fan is disposed in the control housing at the second opening.

14. A compressor system according to claim 12,
wherein a cooling air flow guide for guiding a cooling air flow is formed in the control housing, wherein the fan also drives the cooling air flow.

15. A compressor system according to claim 12,
wherein an air filter is provided and is arranged in the control housing such that the supply air flow is first guided through the supply air filter before reaching the temperature sensor and/or the humidity sensor.

16. A compressor system according to claim 1,
wherein a spacing between the temperature sensor and the processing device of the control device is less than 30 cm, and/or the spacing between the humidity sensor and the processing device of the control device is less than 30 cm.

17. A compressor system according to claim 1,
wherein the temperature sensor is connected directly to the processing device of the control device and the humidity sensor is connected directly to the processing device of the control device without the interposition of additional components and interfaces.

18. A compressor system according to claim 1,
wherein the compressor system has a fluid cooling circuit, the cooling capacity of which can be adjusted via one or more cooling fluid bypass valves, and the control device adjusts the cooling capacity of the fluid cooling circuit taking into account the state conditions comprising the temperature $T_{ein}$ or humidity $F_{ein}$ of the incoming gas flowing in at the inlet opening determined via the temperature sensor or via the humidity sensor.

19. A compressor system according to claim 18, wherein the one or more cooling fluid bypass valves gradually adjust which amount of cooling fluid is fed via a heat exchanger integrated in the fluid cooling circuit or is fed past the heat exchanger.

20. A method for controlling a compressor unit, according to claim 1, taking into account state conditions of the incoming gas flowing in at the inlet opening, wherein a temperature $T_c$ and/or a humidity $F_c$ is determined at or in a control device via a temperature sensor or a humidity sensor in order to detect a temperature $T_c$ prevailing at or in the control device or a humidity $F_c$ prevailing at or in the control device, and in that the measured values $T_c$ and/or $F_c$ are used to draw conclusions about the state conditions of the gas entering at the inlet opening.

21. A method according to claim 20, wherein from the temperature $T_c$ measured at the temperature sensor at or in the control device and from the humidity $F_c$ measured at the humidity sensor at or in the control device, a dew point $Tau_c$ representative of the air in the region of the control device or another value representative of the water vapor content of the air in the region of the control device is calculated and the dew point $Tau_c$ or the value $WDG_c$ representative of the water vapor content is taken into account when determining the target final compression temperature $T_{S,VET}$ of the compressed gas at the outlet opening of the compressor block.

22. A method according to claim 20, wherein the temperature $T_c$ or the humidity $F_c$ is determined in a supply air flow conducted via the control device.

23. A method according to claim 22, wherein the supply air flow passes through a filter to remove particles before it reaches the temperature sensor or the humidity sensor.

24. A method according to claim 20, wherein the temperature $T_c$ measured at the temperature sensor is used to infer a temperature of the gas $T_{ein}$ at the inlet opening of the compressor chamber.

25. A method according to claim 20, wherein the temperature $T_c$ measured at the temperature sensor and the humidity $F_c$ measured at the humidity sensor are used to infer a dew point $T_{ein}$ or a water vapor content $WDG_{ein}$ of the gas at the inlet opening of the compressor chamber.

26. A method according to claim 20, wherein the compressor system is cooled via an adjustable fluid cooling circuit in order to keep a factually actual compression end temperature $T_{I,VET}$ as close as possible to a target final compression temperature $T_{S,VET}$, wherein the cooling capacity of the fluid cooling circuit is set taking into account the state conditions comprising the temperature $T_{ein}$ or the humidity $F_{ein}$ of the gas flowing in at the inlet opening of the compressor system.

27. A method according to claim 26, wherein the cooling capacity of the cooling fluid circuit is set via a bypass regulation.

28. A method according to claim 20, wherein a pressure prevailing in the environment of the control device is determined via a pressure sensor at or in the control device.

29. A method according to claim 20, wherein the method is for adjusting the temperature of the compressed gas at an outlet opening of a compressor block.

30. A compressor system according to claim 1, wherein the compressor system comprises a screw compressor.

* * * * *